US005636406A

United States Patent [19]

Strong

[11] Patent Number: 5,636,406

[45] Date of Patent: Jun. 10, 1997

[54] SELF-ADHERING LOTION APPLICATION PAD

[76] Inventor: Vonda Strong, 2725 Hidden Hills Way, Corona, Calif. 91720

[21] Appl. No.: 541,478

[22] Filed: Oct. 10, 1995

[51] Int. Cl.[6] ..... A47K 7/02; A46B 5/04; A41D 19/00

[52] U.S. Cl. ..... 15/227; 2/20; 2/160; 132/320; 401/7; 601/17

[58] Field of Search ..... 15/104.002, 227; 132/285, 319, 320; 401/7, 8; 601/17, 154; 2/16, 20, 158, 159, 160, 161.6, 161.7, 167

[56] References Cited

U.S. PATENT DOCUMENTS

| | | | |
|---|---|---|---|
| 2,621,784 | 12/1952 | Van Boytham . | |
| 2,763,885 | 9/1956 | Lyons . | |
| 2,880,436 | 4/1959 | Hayden . | |
| 3,056,154 | 10/1962 | Neal . | |
| 3,070,102 | 12/1962 | MacDonald | 401/7 |
| 3,231,918 | 2/1966 | Marks . | |
| 3,321,790 | 5/1967 | Hand . | |
| 3,329,985 | 7/1967 | Glowacki, Jr. . | |
| 4,510,640 | 4/1985 | Omori . | |
| 4,578,826 | 4/1986 | Adiletta | 2/167 |
| 4,643,725 | 2/1987 | Schlesser et al. . | |
| 4,713,274 | 12/1987 | Minor | 15/104.002 |
| 5,003,638 | 4/1991 | Miyake | 2/167 |
| 5,036,551 | 8/1991 | Dailey | 2/167 |

FOREIGN PATENT DOCUMENTS

| | | | |
|---|---|---|---|
| 752591 | 2/1967 | United Kingdom | 15/227 |
| 8900385 | 1/1989 | WIPO | 2/16 |

OTHER PUBLICATIONS

Polyurethane and Polyester Foams Modern Plastics, vol. 32 #2, Nov. 1954.

*Primary Examiner*—Charles E. Cooley
*Assistant Examiner*—Randall Chin
*Attorney, Agent, or Firm*—Wells, St. John, Roberts, Gregory & Matkin, P.S.

[57] ABSTRACT

A self-adhering lotion application pad is described for adhesive attachment to a human hand along the palmar side thereof, covering the palm, fingers, and thumb against contact by lotion. The pad includes a flexible applicator pad body having a lotion applicator surface and an opposed adhesive surface. The pad is generally like a human hand shaped, along a marginal edge surface that defines a finger section, at least one thumb section, and a truncated palm section. An adhesive is provided on the adhesive surface for releasably securing the applicator pad to the hand, covering the palmar sides of the fingers, thumb and palm. A liner is provided, covering the adhesive until separated to expose the adhesive for contact with the user's hand.

17 Claims, 5 Drawing Sheets

SELF-ADHERING LOTION APPLICATION PAD

TECHNICAL FIELD

The present invention relates to lotion application and applicators.

BACKGROUND OF THE INVENTION

Some body lotions such as self-tanning lotions, staining skin medications, and the like have a skin staining or coloration effect. Because any area of the skin is affected by such lotions, application often becomes a problem. If the bare hand is used, the palm is affected by the lotion, and the discoloration is not easily removed.

As a solution to the above problem, plastic or rubber gloves can be used to prevent the lotion from coming into contact with the palmar surface of the hand, fingers, and thumbs. However, the gloves also prevent the lotion from contacting the back sides of the hands and wrists, and a telltale tan line will often result around the forearm in the area of the wrist.

Applicator pads have also been used. However, the pads are susceptible to producing a streaking effect, since even coverage using a pad is not easily achieved. Further, the pads quickly become saturated with lotion and contact with the palmar side of the hand, at least the fingers is practically unavoidable.

The need has therefor remained, until advent of the present invention, to obtain some form of applicator for staining or coloring lotions that will facilitate even application over skin surfaces including the backs of hands and wrists, but that will effectively "mask" the palmar side of the hand, fingers, and thumbs against unintentional staining or coloration.

The present invention fills the above need, as will be understood from the following description, drawings, and claims.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

Figure 1:
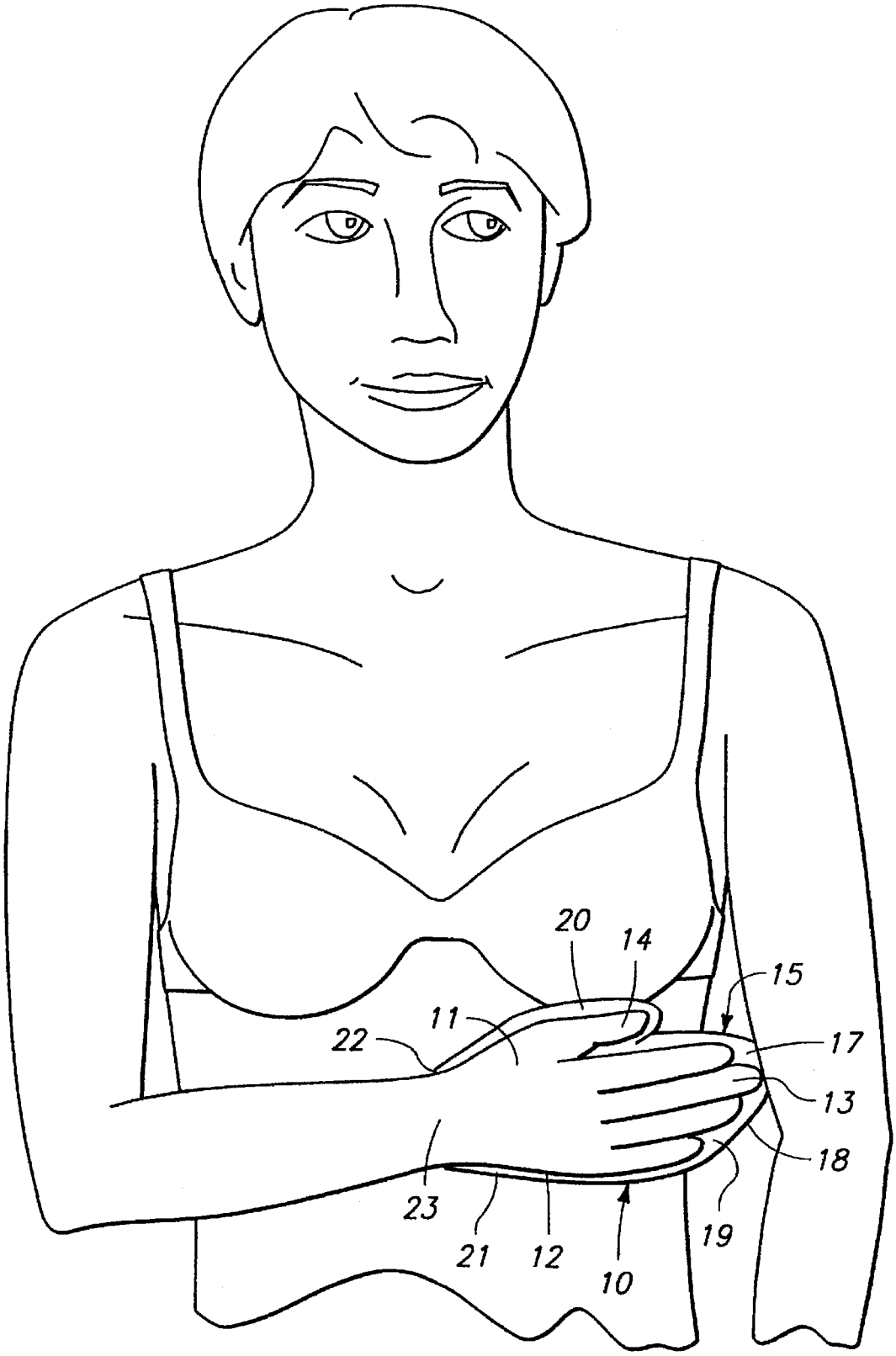
FIG. 1 is an operational view showing the present self-adhering applicator pad in use.

This disclosure of the invention is submitted in furtherance of the constitutional purposes of the U.S. Patent Laws "to promote the progress of science and useful arts" (Article 1, Section 8).

A self-adhering lotion application pad is generally designated in the drawings by the reference numeral 10. The pad 10 is intended for adhesive attachment to a human hand 11 along the palmar side thereof, covering the palm 12, fingers 13, and thumb 14 against contact by lotion.

The pad 10 includes a flexible applicator pad body 15 having a lotion applicator surface 16 and an opposed adhesive surface 17. In general, the preferred applicator pad body 15 is formed of a flexible synthetic resin. Various forms of synthetic resin or "plastic" may be used, including sponge-like material with lotion pre-loaded within the cells thereof. Alternatively, the material could be a thin, flexible material such as polyurethane or other "plastic" having desirable properties such as flexibility, resistance to various lotions, and ability to operate as a substrate for the appropriate adhesive material 24 described below.

More particularly, the pad is formed of a closed cell synthetic resin foam. In the present most preferred form, the body 15 is formed of cross linked ethylene vinyl acetate copolymer foam. An exemplary material is produced under the trademark "VOLARA TYPE EO" by Voltek, a division of Sekisui America at 100 Shepard Street, Lawrence Mass. 01843. It has been found that this material is safe for use, and includes sufficient flexibility to conform to contours of the body when in use, to spread lotions evenly without producing undesired streaking.

In a preferred form, the pad body includes a thickness dimension between the adhesive surface 17 and applicator surface 16 of between approximately 1/64 inches and 1/4 inches. The most preferable thickness dimension is approximately 1/32 inches.

The present applicator pad includes a human hand shaped marginal edge surface 18. The edge surface 18 defines a finger section 19, a thumb section 20, and a truncated palm section 21. These sections form a mir configuration, terminating at a truncated edge 22 that is adapted to be positioned adjacent the wrist area 23 of the user.

Figure 2:
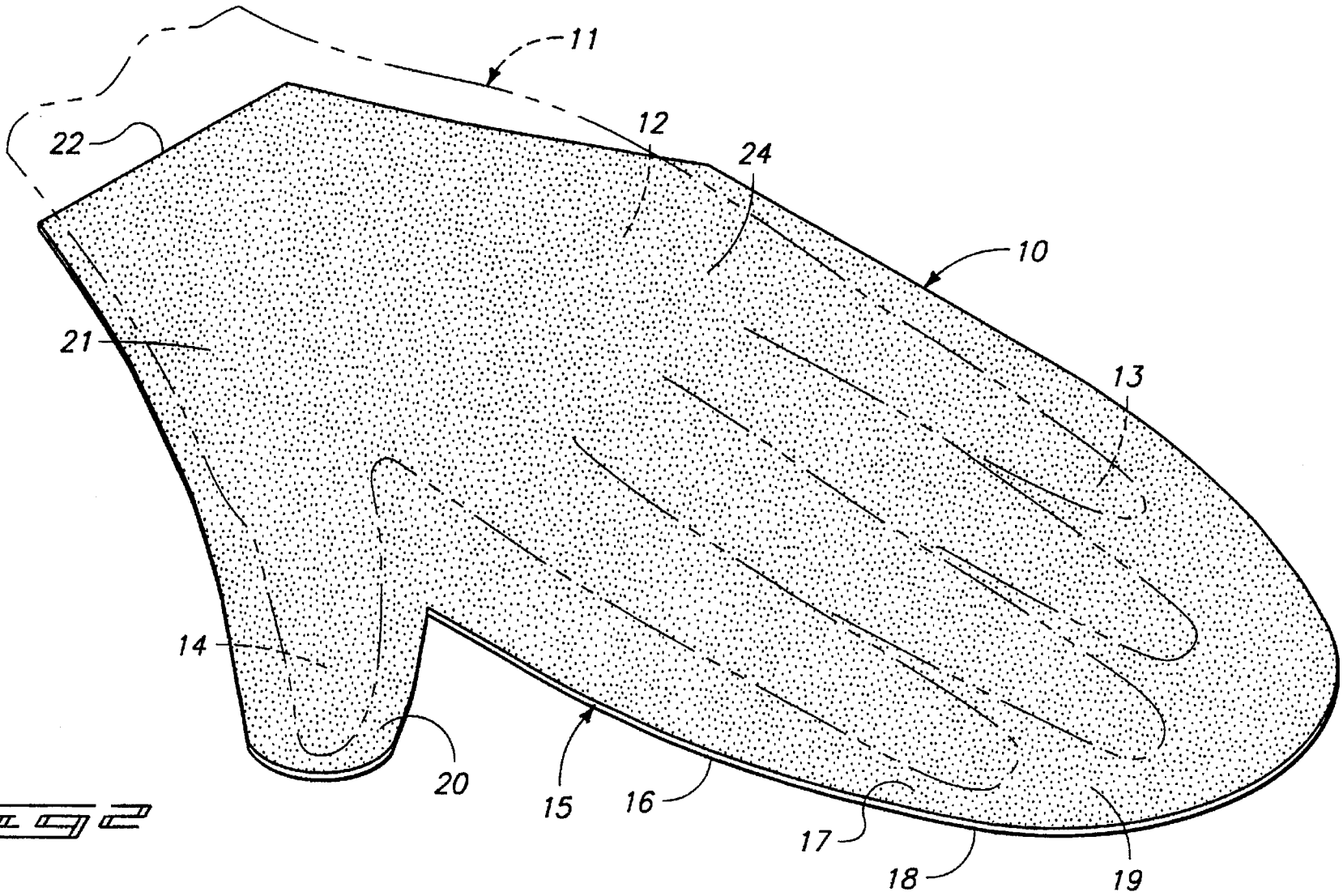
FIG. 2 is a perspective view of the present pad and a user's hand in broken lines.

It is intended that the pad body be formed so the marginal edge surface 18 will slightly overlap the user's hand, as shown in FIGS. 1 and 2, and as such may be formed in several sizes to accommodate various hand sizes.

An adhesive 24 is provided on the adhesive surface 17 for releasably securing the applicator pad to the palmar side of a human hand, covering the palmar sides of the fingers, thumb and palm. The adhesive is advantageously a pressure sensitive adhesive, with a tack strength sufficient to hold the pad on a user's hand during use, but sufficiently weak to allow the pad to be easily removed following use. In a preferred form, the adhesive 24 is applied across the entire adhesive surface 17 and includes a thickness dimension of between approximately 0.5 and 4 mils. A most preferred adhesive thickness is 1 mil.

As provided, the adhesive 24 will adhere the pad to the user's hand covering and sealing the palmar side of the fingers 13, thumb 14 and palm 12 against contact by lotion. Thus the adhesive and pad protect those areas from being colored or stained when the pad is in use.

In a preferred form, the applicator pad includes at least one (FIG. 2) and preferably two opposed thumb sections 20 (FIG. 3), positioned on opposite sides of the applicator pad body to enable use of the pad on a human right or left hand. Thus the user is allowed to select use of the pad on the right or left hand.

Figure 3:
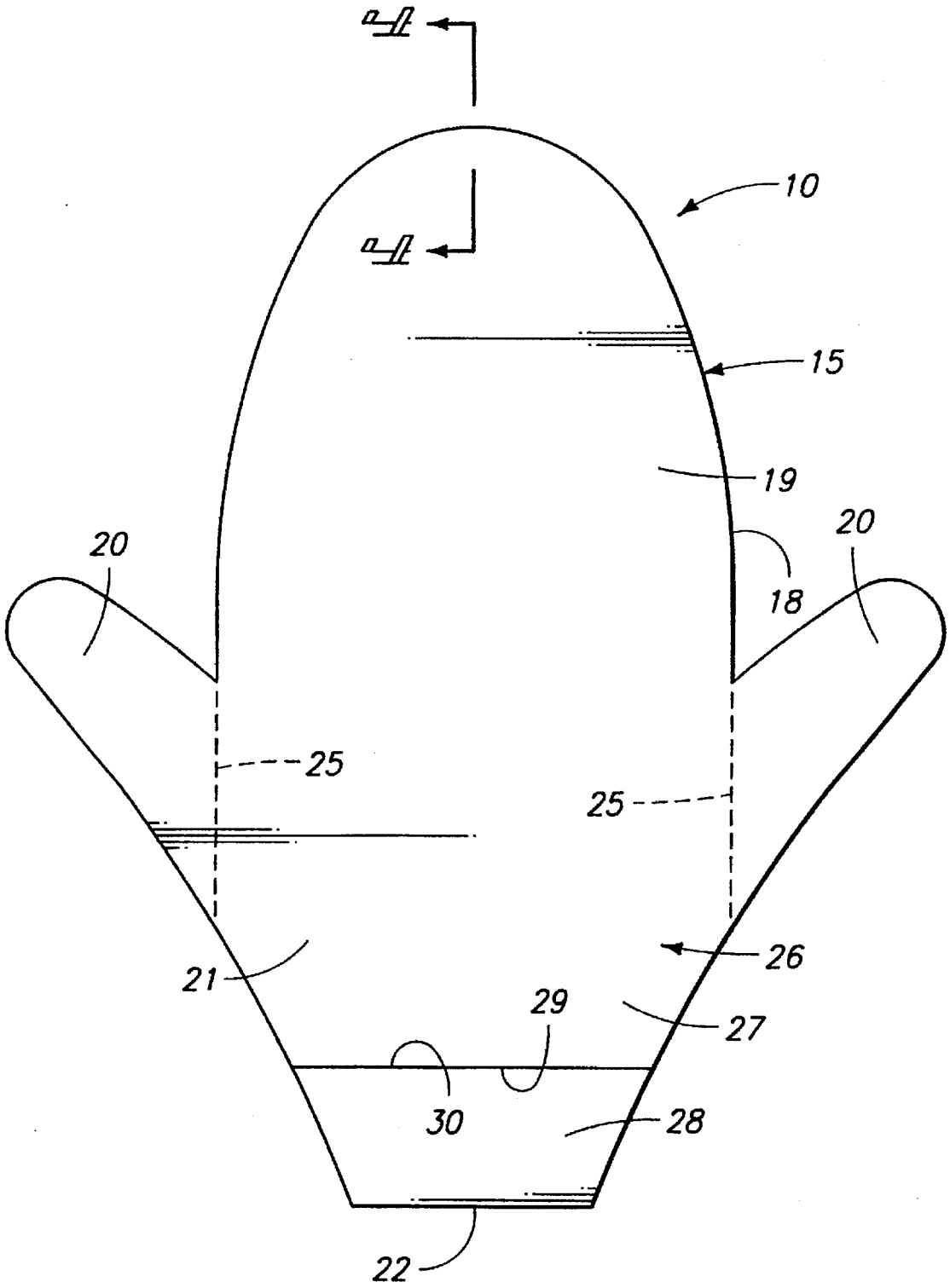
FIG. 3 is a top view of the present pad with opposed thumb sections and a liner in place thereon.
Figure 4A:
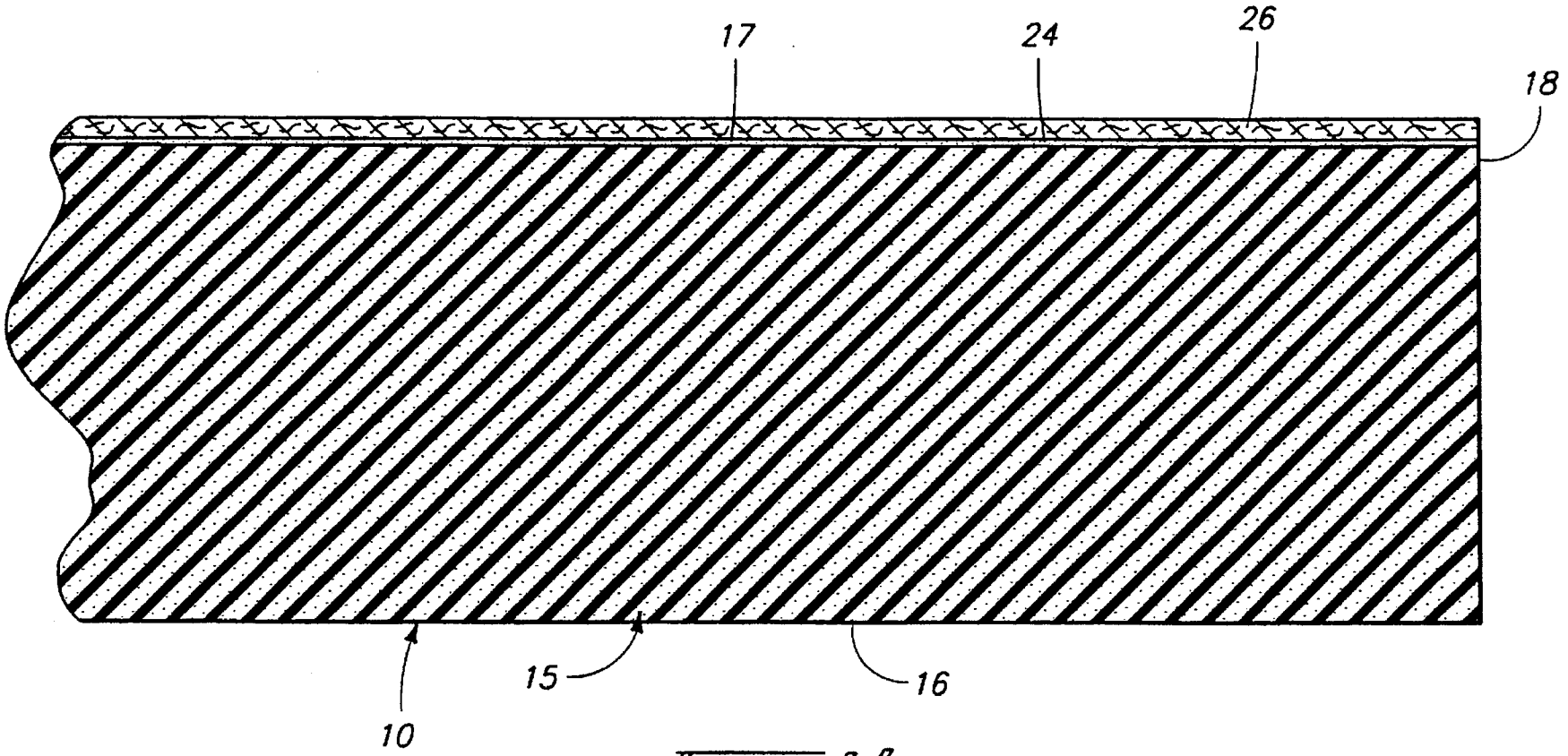
FIG. 4 is an enlarged sectional view of a portion of the pad taken along line 4—4 in FIG. 3.
Figure 5:
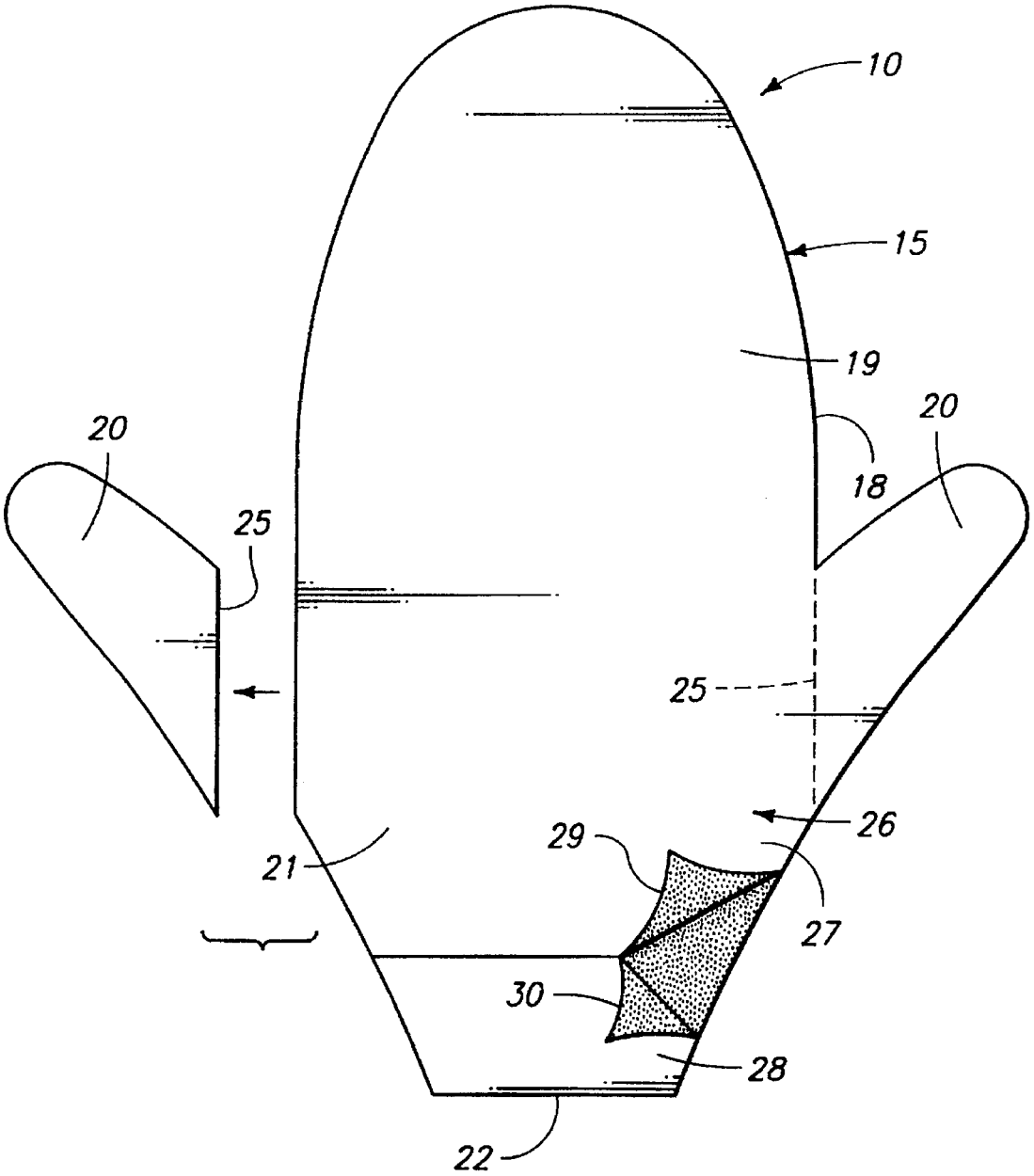
FIG. 5 is a view similar to FIG. 3 only showing one of the thumb sections removed and the liner partially removed.

In a still further preferred form, the thumb sections are selectively separable (FIG. 5) from the applicator pad body 15. To accomplish this, tear strips or perforations 25 are provided through the pad body 15 between the opposed thumb sections 20 and palm section 21. Either of the thumb sections may be removed by tearing the selected thumb section 20 along the tear strips or perforations 25. Alternatively, the thumb sections 20 may both remain in place, as shown in FIG. 3. With the pad in this configuration, the user may simply attach the pad to one hand and apply lotion with the pad on that hand. Next, the user may remove the pad from the one hand and apply it to the other hand to finish application. Both thumb sections 20 would be used in this process without being removed from the pad.

If the pad is produced with a single thumb section as shown in FIG. 2, two pads 10 may be provided; one for each hand.

In a preferred form, a removable liner 26 is provided covering the adhesive surface 17 to the marginal edge surface 18. The liner 26 may remain on the pad body 15, protecting the adhesive 24 until such time that the pad is to be used. The liner may be formed of paper.

Liner 26 may be provided in two sections 27, 28, abutting along mating edges 29, 30 that span the adhesive surface of the applicator pad body. The edges 29, 30 may be lifted successively (see FIG. 5) to remove the associated liner section from the pad.

Given the above description of the presently preferred pad 10, its use will be readily understood.

Prior to use, the user first determines which hand (right or left) to which the pad is to be applied. If the pad is provided with removable thumb sections 20 as shown in FIG. 3, the user may elect to tear the unused thumb section away, along the tear strip or perforated line 25. The user may alternatively wish to initially allow both thumb sections to remain on the pad body, then tear the used thumb section away before applying the pad to the other hand.

Now the user can expose the adhesive 24 by removing the liner 26. This is done simply by lifting the mating edges 29, 30 upwardly and pulling the remainder of the liner sections 27, 28 from the adhesive surface 17. The pad may now be attached to the user's hand.

The pad is attached simply by pressing the selected hand onto the adhesive surface, taking care to substantially center the hand 11 with the fingers 13 engaging the finger section 19, the thumb 14 engaging the appropriate thumb section 20, and the palm 12 engaging the palm section 21. The truncated edge 22 will automatically be positioned adjacent the user's wrist 23.

The adhesive 17 will releasably secure the pad to the user's hand, and at the same time seal the engaged surfaces of the hand against contact by the lotion to be applied. The lotion may now be applied to the lotion applicator surface 16. The applicator surface and lotion can now be rubbed over those selected areas of the body to which lotion is to be applied. This process is repeated until a desired amount of the lotion is applied. The pad can then be removed, by peeling the pad body from the engaged parts of the hand, and be discarded, or applied to the opposite hand where the lotion application process can be repeated once again.

When the lotion application process is complete, the pad can be removed from the hand and discarded. All during these process steps, the pad both functions to evenly spread the lotion and prevent the lotion from contacting those parts of the hands covered by the pad and adhesive.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A self-adhering lotion application pad for adhesive attachment to a human hand along the palmar side thereof, covering the palm, fingers, and thumb against contact by lotion, comprising:

a flexible applicator pad body having a lotion applicator surface and an opposed adhesive surface;

wherein the applicator pad includes a human hand shaped marginal edge surface, defining a finger section, a thumb section, and a truncated palm section;

adhesive on the adhesive surface for releasably securing the applicator pad to the palmar side of a human hand, covering the palmar sides of the fingers, thumb and palm; and wherein the applicator pad body includes opposed thumb sections positioned on the applicator pad body to enable alternative use of the pad on a human right or left hand; and wherein the thumb sections are selectively separable from the applicator pad body.

2. A self-adhering lotion application pad as claimed by claim 1 and further comprising tear strips between the thumb sections and palm section to enable selective removal of either thumb section from the applicator pad body.

3. A self-adhering lotion application pad as claimed by claim 1 wherein the applicator pad body is formed of flexible synthetic resin.

4. A self-adhering lotion application pad as claimed by claim 1 wherein the applicator pad body is formed of closed cell synthetic resin foam.

5. A self-adhering lotion application pad as claimed by claim 1 wherein the applicator pad body is formed of closed cell synthetic resin foam having a thickness dimension between the adhesive surface and applicator surface of between approximately 1/64 inches and 1/4 inches.

6. A self-adhering lotion application pad as claimed by claim 1 wherein the applicator pad body is formed of cross linked ethylene vinyl acetate copolymer foam.

7. A self-adhering lotion application pad as claimed by claim 1 wherein the adhesive includes a thickness dimension of between approximately 0.5 and 4 mil.

8. A self-adhering lotion application pad as claimed by claim 1 wherein the adhesive includes a thickness dimension of between approximately 0.5 and 4 mil; and wherein the applicator pad body is formed of synthetic resin having a thickness dimension between the adhesive surface and applicator surface of between approximately 1/64 inches and 1/4 inches.

9. A self-adhering lotion application pad as claimed by claim 1 wherein the applicator pad body is formed of cross linked ethylene vinyl acetate copolymer foam having a thickness dimension between the adhesive surface and applicator surface of between approximately 1/64 inches and 1/4 inches; and wherein the adhesive includes a thickness dimension of between approximately 0.5 and 4 mil.

10. A self-adhering lotion application pad as claimed by claim 1 further comprising a removable liner covering the adhesive surface, removable from the applicator pad body to expose the adhesive surface.

11. A self-adhering lotion application pad as claimed by claim 1 further comprising a removable liner provided in two sections abutting along mating edges that span the adhesive surface of the applicator pad body;

wherein the two sections of the removable liner cover the adhesive surface; and wherein the two sections are removable from the applicator pad body to expose the adhesive surface.

12. A self-adhering lotion application pad for adhesive attachment to a human hand along the palmar side thereof, covering the palm, fingers, and thumb against contact by lotion, comprising:

a flexible applicator pad body having a lotion applicator surface and an opposed adhesive surface;

wherein the applicator pad includes a mitt configuration with a marginal edge surface defining a finger section, a thumb section, and a truncated palm section;

adhesive on the adhesive surface for releasably securing the applicator pad to the palmar side of a human hand, covering the palmar sides of the fingers, thumb and palm;

a removable liner covering the adhesive surface, removable from the applicator pad body to expose the adhesive surface;

wherein the applicator pad body includes opposed thumb sections positioned on the applicator pad body to enable alternative use of the pad on a human right or left hand; and perforations between the thumb sections and palm section enabling selective separation of either thumb section from the applicator pad body.

13. A self-adhering lotion application pad for adhesive attachment to a human hand along the palmar side thereof, covering the palm, fingers, and thumb against contact by lotion, comprising:

a flexible applicator pad body having a lotion applicator surface and an opposed adhesive surface;

wherein the applicator pad includes a human hand shaped marginal edge surface, defining a finger section, a truncated palm section, and two opposed thumb sections on the palm section;

perforations between the thumb sections and palm section, enabling removal of the thumb sections from the palm section; and adhesive on the adhesive surface for releasably securing the applicator pad to the palmar side of a human hand, covering the palmar sides of the fingers, thumb and palm.

14. A self-adhering lotion application pad as claimed by claim 13 further comprising a removable liner provided in two sections abutting along mating edges that span the adhesive surface of the applicator pad body;

wherein the two sections of the removable liner cover the adhesive surface; and wherein the two sections are removable from the applicator pad body to expose the adhesive surface.

15. A self-adhering lotion application pad as claimed by claim 13 wherein the adhesive is a pressure sensitive adhesive and further comprising a removable liner releasably engaging the adhesive surface.

16. A self-adhering lotion application pad as claimed by claim 13:

wherein the applicator pad body is formed of a flexible closed cell synthetic resin having a thickness dimension between the adhesive surface and applicator surface of between approximately 1/64 inches and 1/4 inches;

wherein the adhesive is a pressure sensitive adhesive having a thickness dimension of between approximately 0.5 and 4 mil.;

and further comprising a removable liner releasably engaging the adhesive surface.

17. A self-adhering lotion application pad for adhesive attachment to a human hand along the palmar side thereof, covering the palm, fingers, and thumb against contact by lotion, comprising:

a flexible applicator pad body having a lotion applicator surface and an opposed adhesive surface;

wherein the applicator pad body is formed in a mitt configuration with a marginal edge surface defining a single finger section shaped to span four fingers of a human hand, a truncated palm section, and two opposed thumb sections on the palm section;

wherein the two opposed thumb sections are symmetrical on the pad body along a medial line substantially longitudinally bisecting the finger section and truncated palm section;

adhesive on the adhesive surface for releasably securing the applicator pad to the palmar side of a human hand, covering the palmar sides of the fingers, thumb and palm.

* * * * *